US008814240B2

(12) United States Patent
Hedley

(10) Patent No.: US 8,814,240 B2
(45) Date of Patent: Aug. 26, 2014

(54) ENGAGEMENT ASSEMBLY AND METHOD

(75) Inventor: Robert Ian Hedley, Buttaba (AU)

(73) Assignee: Justoy Pty Limited, Mount Thorley via Singleton, NSW (AU)

( * ) Notice: Subject to any disclaimer, the term of this patent is extended or adjusted under 35 U.S.C. 154(b) by 0 days.

(21) Appl. No.: 13/810,643

(22) PCT Filed: Jul. 26, 2011

(86) PCT No.: PCT/AU2011/000939
§ 371 (c)(1),
(2), (4) Date: Jun. 4, 2013

(87) PCT Pub. No.: WO2012/012825
PCT Pub. Date: Feb. 2, 2012

(65) Prior Publication Data

US 2013/0300142 A1 Nov. 14, 2013

(30) Foreign Application Priority Data

Jul. 26, 2010 (AU) ..... 2010903336

(51) Int. Cl.
*B66C 1/66* (2006.01)

(52) U.S. Cl.
CPC ..... *B66C 1/66* (2013.01)
USPC ..... 294/97; 294/93; 294/117

(58) Field of Classification Search
USPC ..... 294/97, 93, 89, 94, 95, 96, 103.1, 195, 294/117, 118; 52/125.5, 699; 411/45, 548; 403/186, 206
See application file for complete search history.

(56) References Cited

U.S. PATENT DOCUMENTS

| | | | | |
|---|---|---|---|---|
| 264,547 | A * | 9/1882 | McCosh | 294/16 |
| 314,243 | A | 3/1885 | Heathcote | |
| 813,384 | A | 2/1906 | Kiefer | |
| 1,851,116 | A * | 3/1932 | Spiro | 294/95 |
| 2,514,692 | A | 7/1950 | Carson | |
| 2,832,633 | A * | 4/1958 | Compson | 294/97 |
| 2,895,430 | A | 7/1959 | Dunlap | |
| 3,652,118 | A | 3/1972 | Goldberg | |
| 4,068,879 | A | 1/1978 | Torbet | |
| 4,223,935 | A * | 9/1980 | Rayner et al. | 294/16 |
| 4,634,166 | A * | 1/1987 | Pool | 294/103.1 |
| 7,007,992 | B2 * | 3/2006 | Young | 294/97 |
| 7,669,905 | B1 * | 3/2010 | Kondo | 294/97 |
| 7,823,944 | B1 * | 11/2010 | Kondo | 294/97 |
| 8,651,540 | B2 * | 2/2014 | Daniel | 294/97 |
| 2002/0096897 | A1 * | 7/2002 | Comardo et al. | 294/95 |

FOREIGN PATENT DOCUMENTS

GB 2337983 A 12/1999

OTHER PUBLICATIONS

International Application No. PCT/AU2011/000939, filed Jul. 26, 2011, PCT Written Opinion of the International Preliminary Examining Authority, 6 pages.

* cited by examiner

*Primary Examiner* — Paul T Chin
(74) *Attorney, Agent, or Firm* — Kilpatrick Townsend & Stockton LLP

(57) ABSTRACT

An engagement assembly, adapted to securely engage an orifice of an article. The engagement assembly includes a plurality of elongate fingers which are transversely movable relative to each other, each finger having an end flange thereon. The engagement assembly has an insertion position, wherein said fingers are contracted together, such that said flanges are adapted to be inserted through said orifice of said article; and, an engaged position, wherein said fingers are flared outwards relative to said insertion position, such that said flanges are adapted to thereby prevent withdrawal of said assembly from said orifice.

6 Claims, 15 Drawing Sheets

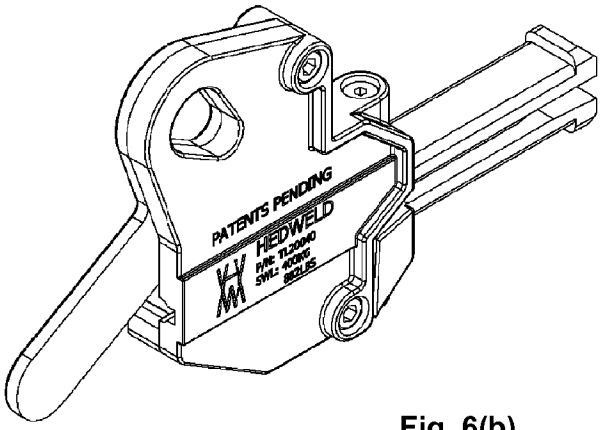
Fig. 6(b)
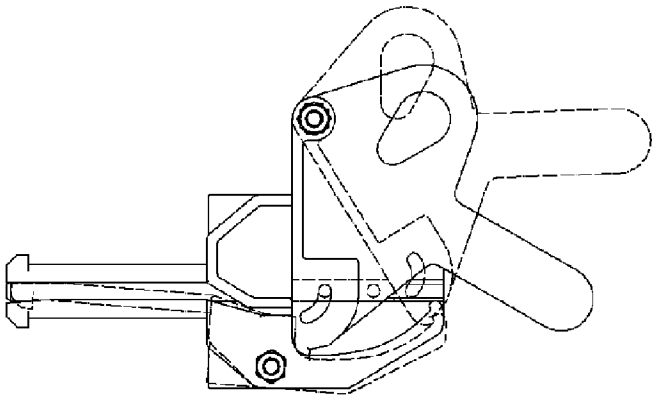
FIG. 6(c)
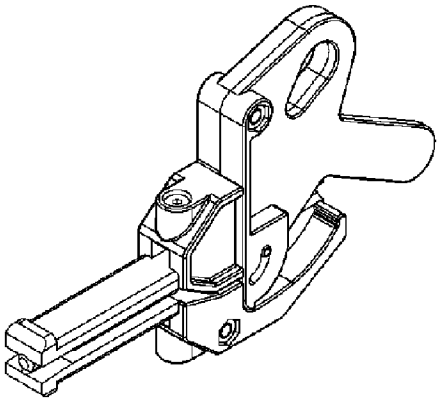
FIG. 6(a)
FIG. 6

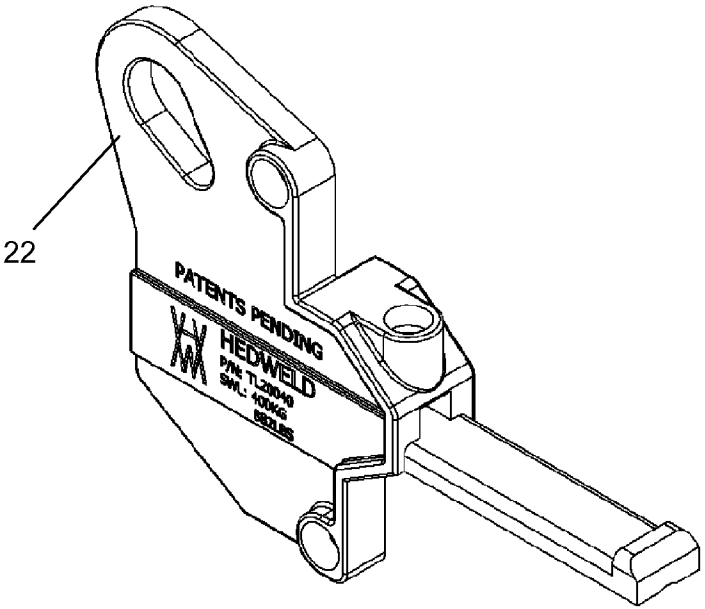
Fig. 7(a)
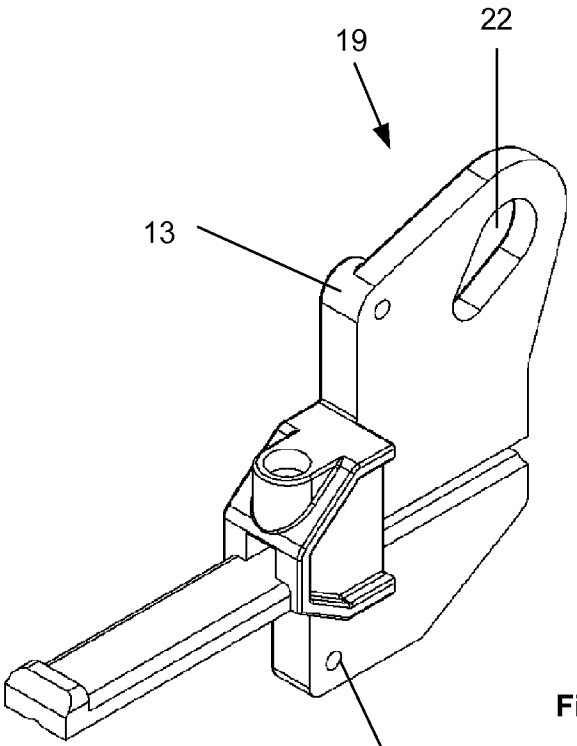
Fig. 7(b)
FIG. 7

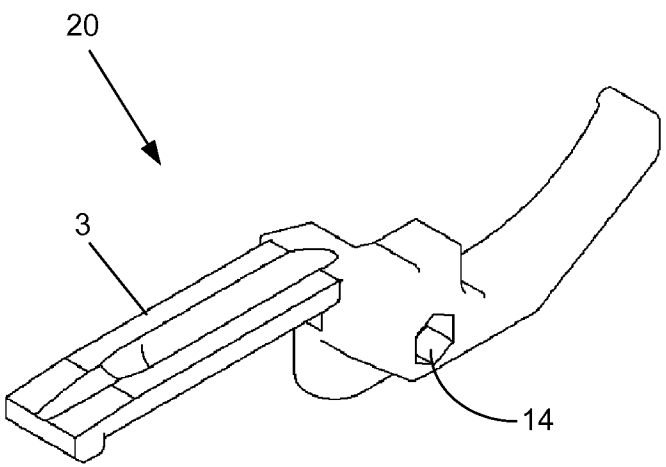
FIG. 8(b)
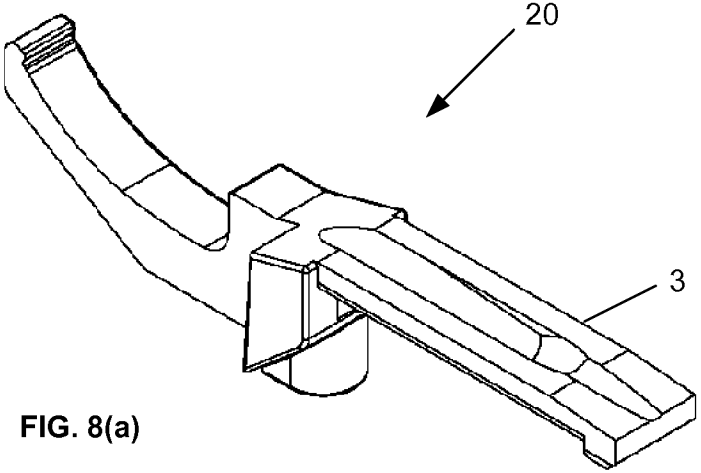
FIG. 8(a)
FIG. 8

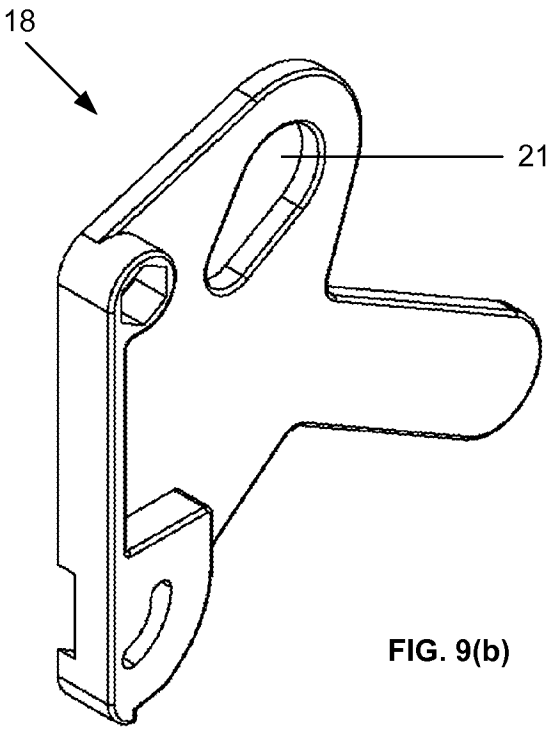
FIG. 9(b)
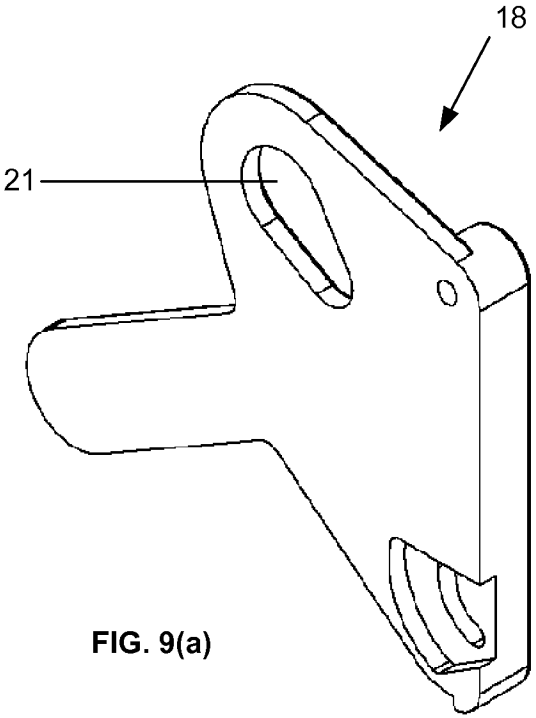
FIG. 9(a)
FIG. 9

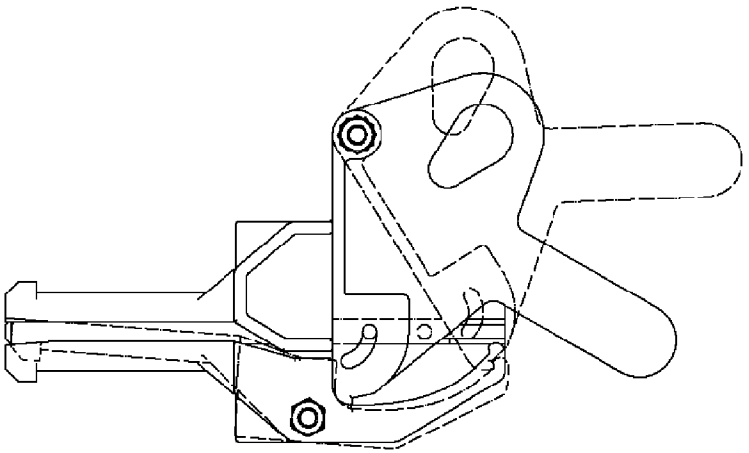
FIG. 11(b)
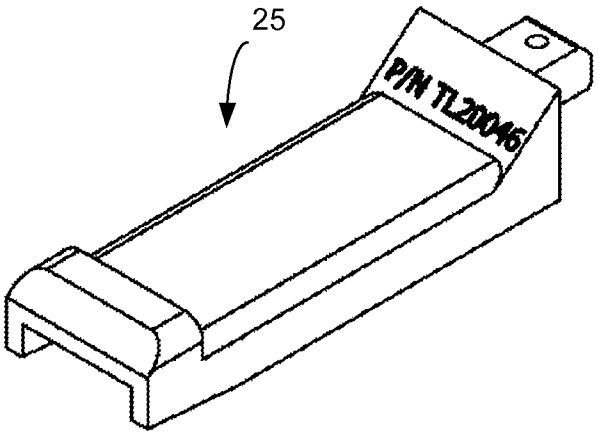
FIG. 11(a)
FIG. 11

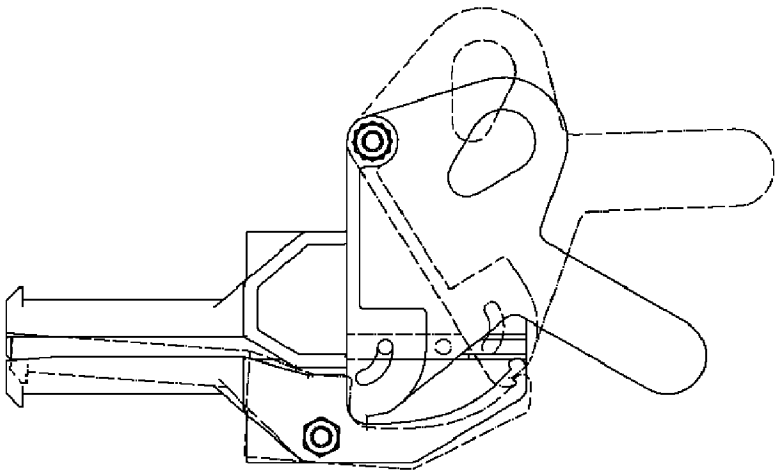
FIG. 12(b)
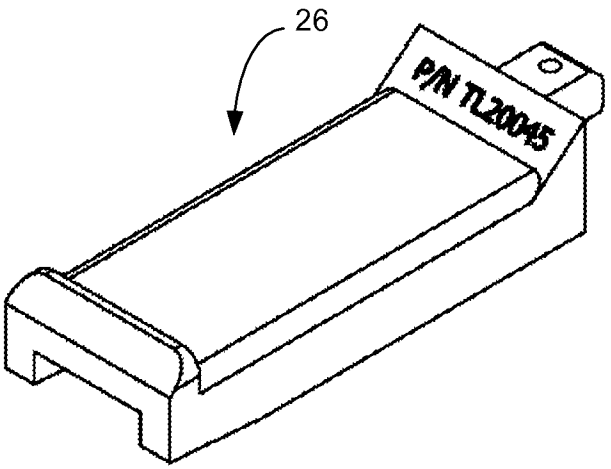
FIG. 12(a)
FIG. 12

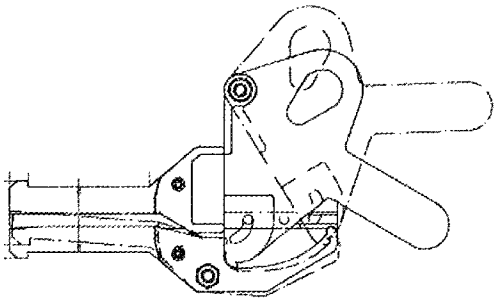
FIG. 13(b)
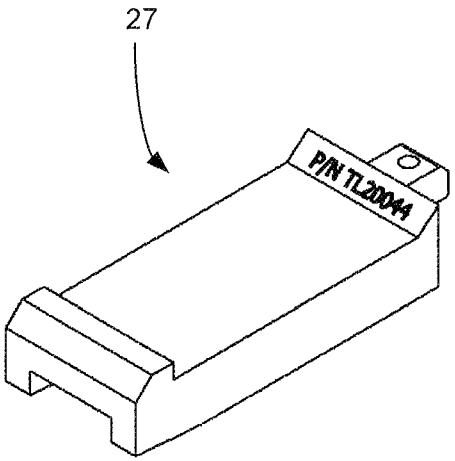
FIG. 13(a)
FIG. 13

ENGAGEMENT ASSEMBLY AND METHOD

BACKGROUND OF THE INVENTION

The present invention relates to an engagement assembly which is adapted to securely engage an orifice of an article. In particular, the present invention relates to an engagement assembly which is particularly useful for attaching intermediate an article and a lifting apparatus, for installing and removing articles such as mining equipment components, such as, but not limited to, cutting edge components from heavy earth moving vehicles.

DESCRIPTION OF THE PRIOR ART

When installing or removing components such as cutting edges from heavy equipment, such as earth moving vehicles, it is desirable to use a suitable lifting device, as such components are typically extremely heavy. When using such lifting devices, such as cranes or manual floor lifts, it is often difficult to securely fasten the component to the crane or floor lift in a suitably safe manner such that it is unlikely to drop and cause damage or injury. Typically, such components do not incorporate specialised means for attachment of a shackle or lifting hook, and as such, makeshift arrangements are often utilised, for instance, by placing the lifting hook or shackle through a bolt hole of the component.

It will be appreciated by persons skilled in the art that the installation and removal of such components from such equipment is often hazardous. This therefore identifies a need for an engagement assembly for more safely and securely engaging such articles.

SUMMARY OF THE INVENTION

The present invention seeks to provide an engagement assembly which is adapted to securely engage an article, which overcomes the disadvantages of the prior art.

In one broad form, the present invention provides an engagement assembly, adapted to securely engage an orifice of an article, said engagement assembly including a plurality of elongate fingers which are transversely movable relative to each other, each finger having an end flange thereon, said engagement assembly having: an insertion position, wherein said fingers are contracted together, such that said flanges are adapted to be inserted through said orifice of said article; and, an engaged position, wherein said fingers are flared outwards relative to said insertion position, such that said flanges are adapted to thereby prevent withdrawal of said assembly from said orifice.

Preferably, the engagement assembly further includes a shank disposed intermediate said fingers, said shank being axially movable in a substantially reciprocating manner, wherein: in said insertion position, said shank is withdrawn to permit said end flanges to be positional proximal relative to each other; and, in said engaged position, said shank is extended to be positioned substantially intermediate said flanges to thereby substantially prevent said end flanges moving together.

Also preferably, the engagement assembly further includes a lever, to effect relative movement of at least one of said fingers.

Preferably, said shank is attached to said lever such that movement of said lever causes said axial movement of said shank which, being intermediate of said finger, in turn thereby effects relative movement of said fingers between said insertion position and said engaged position.

Also preferably, said shank is attached to said lever via a slidable pivot pin.

Preferably, the engagement assembly further includes a main body, including a plurality of body portions pivotally movable relative to each other, at least one body portion having one of said fingers extending integrally therefrom which thereby moves with its respective body portion in a scissor-like movement relative to another of said body portions and its respective finger extending therefrom.

Preferably, at least one of said body portions has said shank and said lever attached thereto.

Also preferably, each of said pivotally movable body portions include a cutout therein, whereby, in said engaged position of said assembly, said cutouts are substantially aligned.

Preferably, in said engaged position, an insert is adapted to be provided in said aligned cutouts, to thereby retain said engagement assembly in said engaged position.

Also preferably, said assembly is used to engage a bolt hole or like orifice of a cutting edge or other component of an earthmoving, agricultural or like equipment.

Preferably, said insert is a shackle or lifting hook of a crane or other lifting device.

Preferably, the engagement assembly further includes a cover, attachable to at least one of said fingers, to thereby adjust the size or shape of said finger(s) such that said finger(s) are of compatible size or shape to said orifice.

Preferably, each said cover is removably attachable to said finger.

In a further broad form, the present invention provides a method of securing an engagement assembly to an orifice of an article, the engagement assembly including a plurality of elongate fingers, each finger having an end flange thereon, said method including the steps of: placing said engagement assembly in an insertion position; inserting said fingers through said orifice; and actuating said engagement assembly to said engaged position, such that said flanges thereby prevent withdrawal of said assembly from said orifice.

Preferably, the method further includes the initial step of attaching a cover to at least one of said fingers.

BRIEF DESCRIPTION OF THE DRAWINGS

The present invention will become more fully understood from the following detailed description of a preferred but non-limiting embodiment thereof, described in connection with the accompanying drawings, wherein:

FIG. 6 shows, in FIGS. 6(*a*), 6(*b*) and 6(*c*), front isometric, rear isometric, and side views (showing open and closed positions), respectively of the master assembly;

FIG. 7 shows, in FIGS. 7(*a*) and 7(*b*), front and rear isometric views, respectively, of the first body component (including the top prong/finger);

FIG. 8 shows, in FIGS. 8(*a*) and 8(*b*), front and rear isometric views, respectively, of the second body component (including the bottom prong/finger);

FIG. 9 shows, in FIGS. 9(*a*) and 9(*b*), front and rear isometric views, respectively, of the third body component (including the handle);

FIG. 11 shows, in FIG. 11(*a*), an isometric view of a small cover which may be removably attached to the assembly, and, in FIG. 11(*b*), a side elevation of the assembly incorporating the small cover of FIG. 11(*a*);

FIG. 12 shows, in FIG. 12(*a*), an isometric view of a mid-size cover, and, in FIG. 12(*b*), a side elevation of the assembly incorporating the mid-size cover of FIG. 12(*a*);

FIG. 13 shows, in FIG. 13(*a*), an isometric view of a large cover, and, in FIG. 13(*b*), a side elevation of the assembly incorporating the large cover of FIG. 13(*b*).

DETAILED DESCRIPTION OF PREFERRED EMBODIMENTS

Figure 1A:
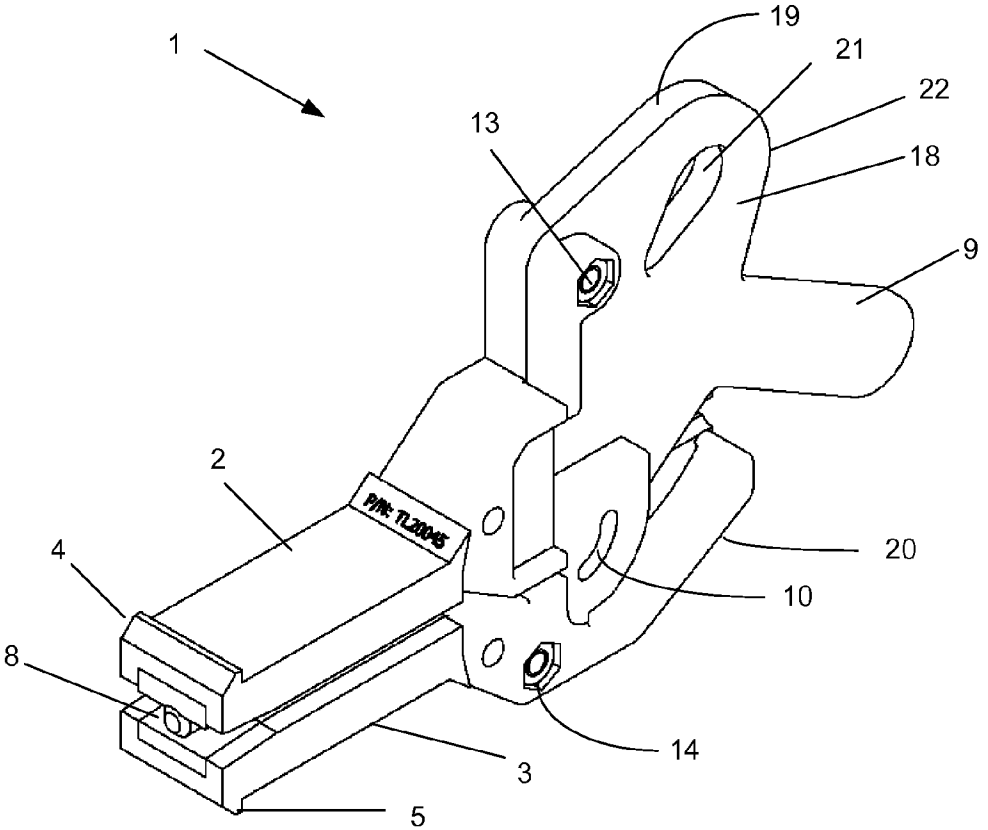
FIG. 1 illustrates perspective views of the engagement assembly of the present invention, FIG. 1(*a*) showing a front perspective view, and FIG. 1(*b*) showing a rear perspective view.
Figure 1B:
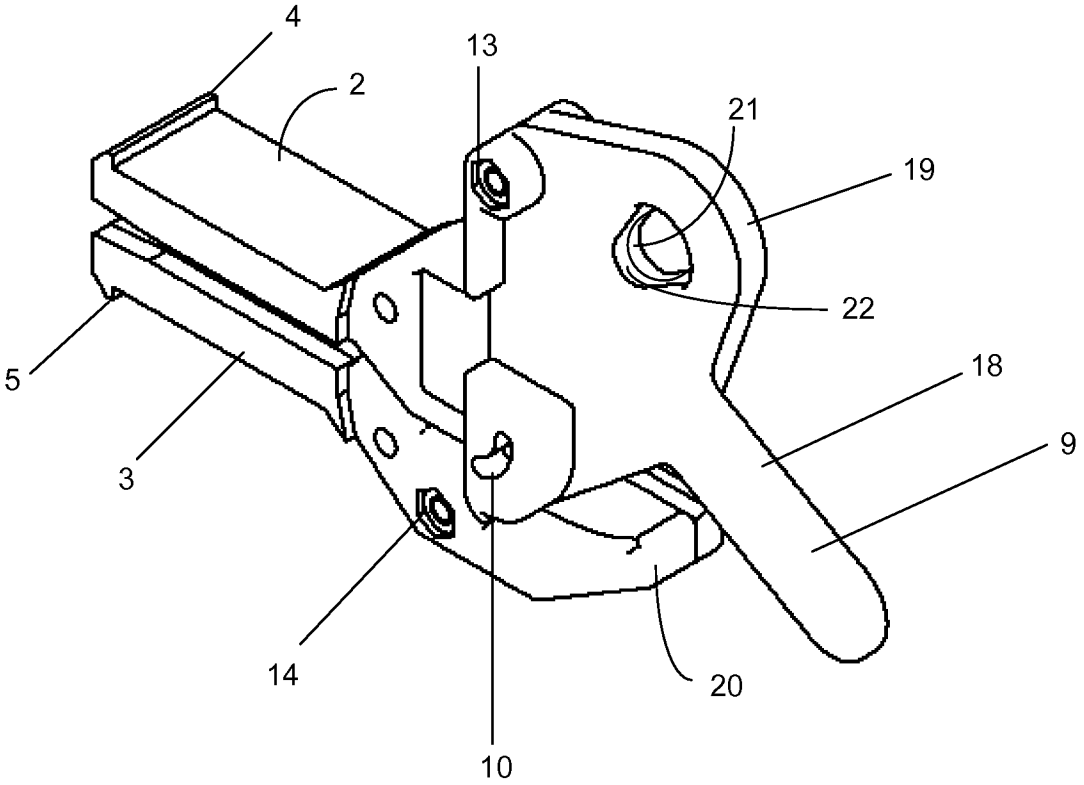

The engagement assembly of the present invention, as illustrated in FIG. 1(*a*) and FIG. 1(*b*) and generally designated by the numeral 1, is a "scissor-like" device, which includes a pair of elongate fingers or prongs 2 and 3, and a handle 9, for movement of the fingers or prongs.

The fingers or prongs 2 and 3 may be moved, by operation of the lever 9, between an 'engaged position', and a 'disengaged/insertion position'.

The assembly 1 is typically used to be attached to an article, and also for attachment to a crane, hoist or like lifting apparatus. Thereby, the article to be moved may be securely fastened to the crane. The apparatus is typically used for lifting heavy articles, such as mining equipment wear plates, which have appropriate orifices already supplied therein, for movement of the mining equipment components during installation, disassembly or servicing.

Figure 2A:
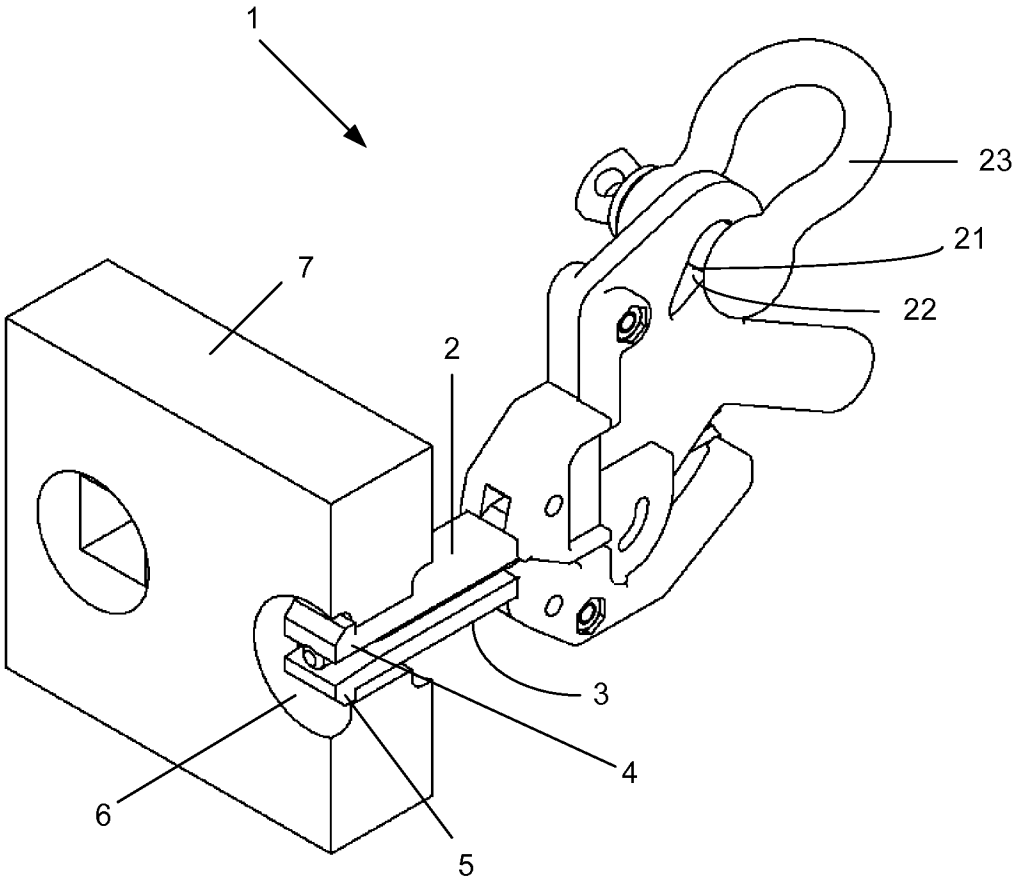
FIG. 2 illustrates perspective views of the engagement assembly of FIG. 1, in use, FIG. 2(*a*) showing a front perspective view, and FIG. 2(*b*) showing a rear perspective view.
Figure 2B:
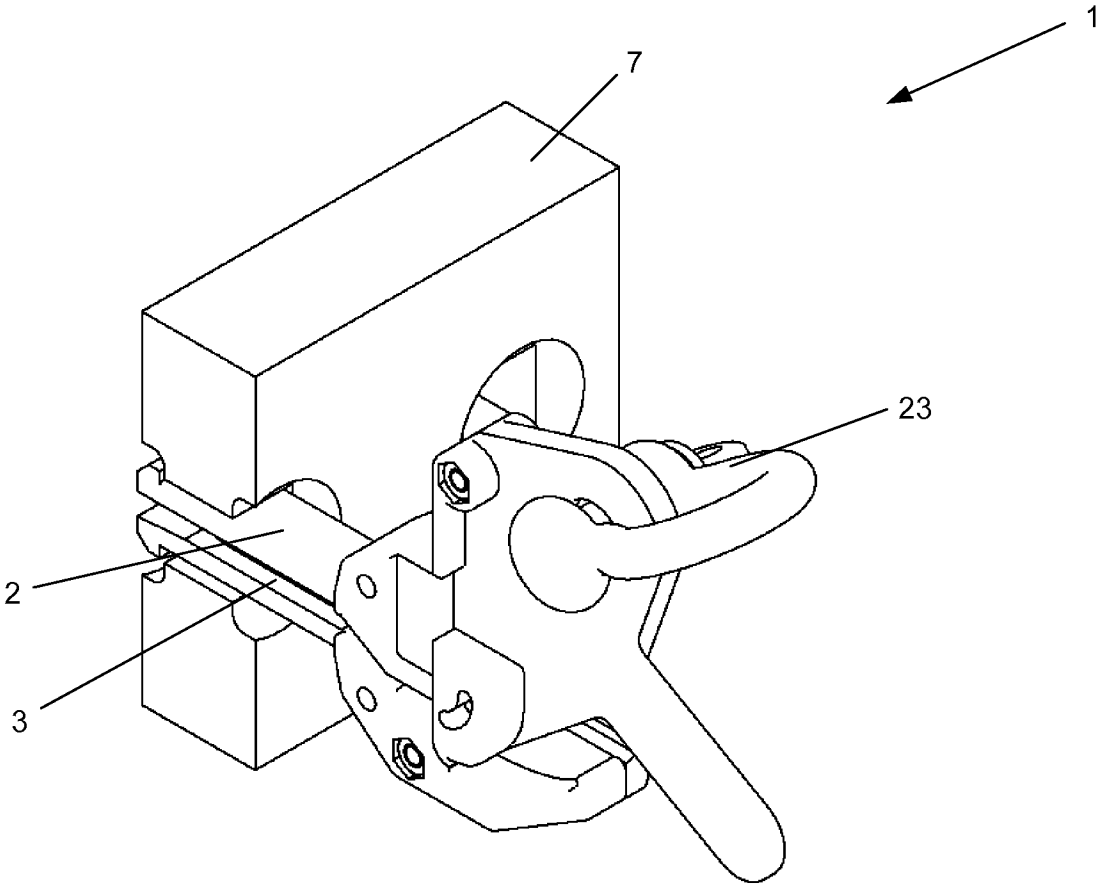

In an engaged position, as illustrated in FIGS. 2(*a*) and 2(*b*), the prongs 2 and 3 are inserted through an orifice 6 of an article 7. The fingers 2 and 3 each have an end flange 4 and 5 thereon to retain the engagement assembly 1 within the orifice 6 of the article 7 whilst the engagement assembly 1 is in the engaged configuration as illustrated in FIG. 2.

The engaged assembly 1 is retained in the engaged position as shown in FIGS. 2(*a*) and 2(*b*) by some form of insert 23 being positioned in the aligned cut-outs 21 and 22, to thereby retain the engagement assembly in the engaged positions. The insert may be a bolt, hook, or other insert of appropriate shape, preferably fitting snugly in the aligned cut-outs 21 and 22, to thereby prevent relative movement therebetween.

In use, the engagement assembly may then be used to thereby engage a crane or like assembly to a cutting edge or other component, to lift the component/object and/or otherwise move the component/object as may be required in a workshop situation.

Whilst the embodiment illustrated shows a pair of fingers, it would be appreciated that additional fingers may be provided in configurations which would become apparent to persons skilled in the art.

Figure 3:
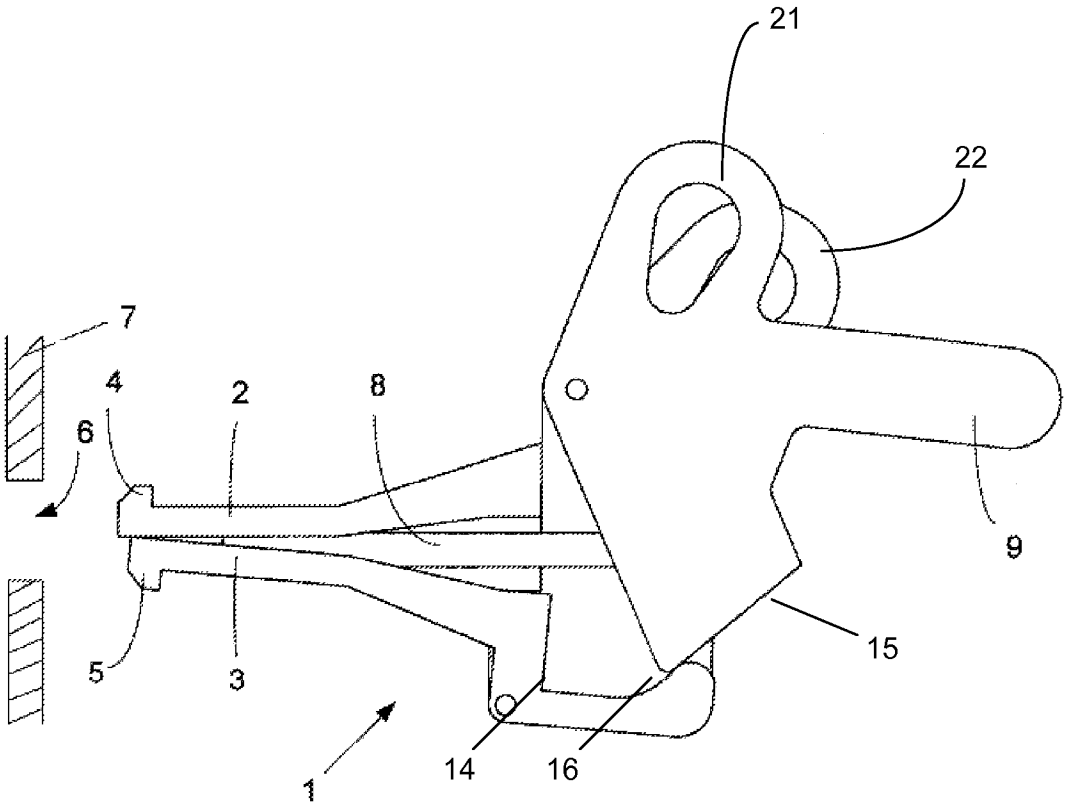
FIG. 3 illustrates a side view of the engagement assembly in the insertion/disengaged position.
Figure 4:
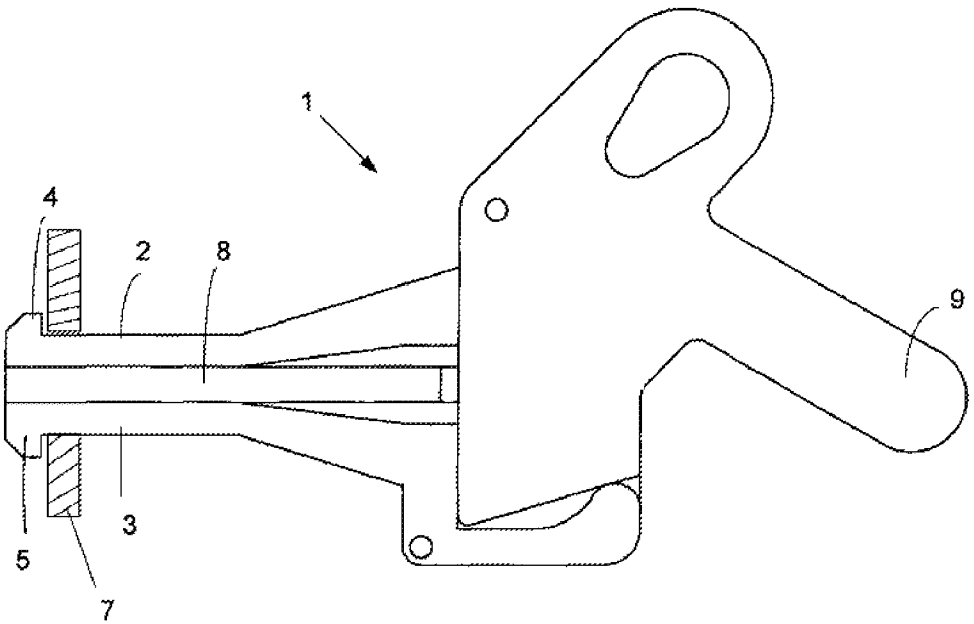
FIG. 4 illustrates a side view of the engagement assembly in the engaged position.
Figure 5:
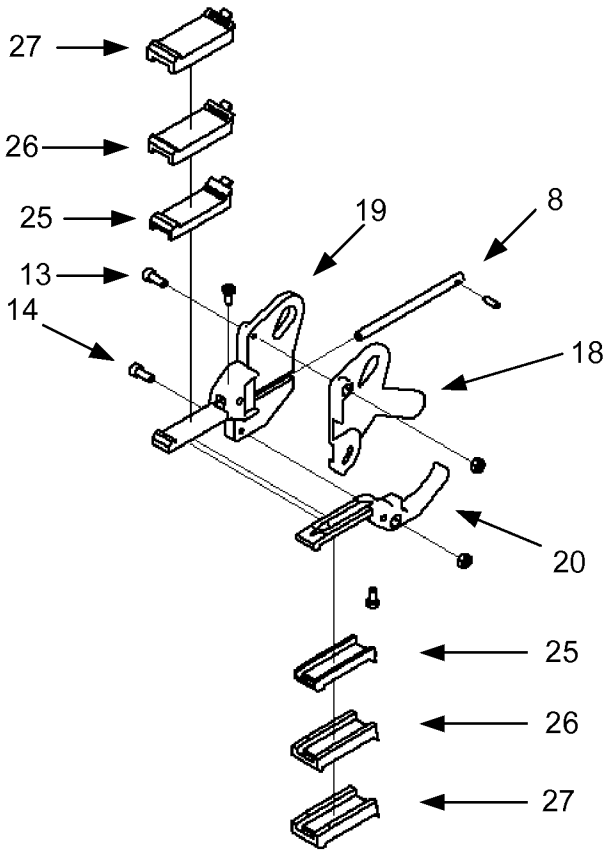
FIG. 5 shows an exploded view of the engagement assembly, illustrating the main components thereof.
Figure 10:
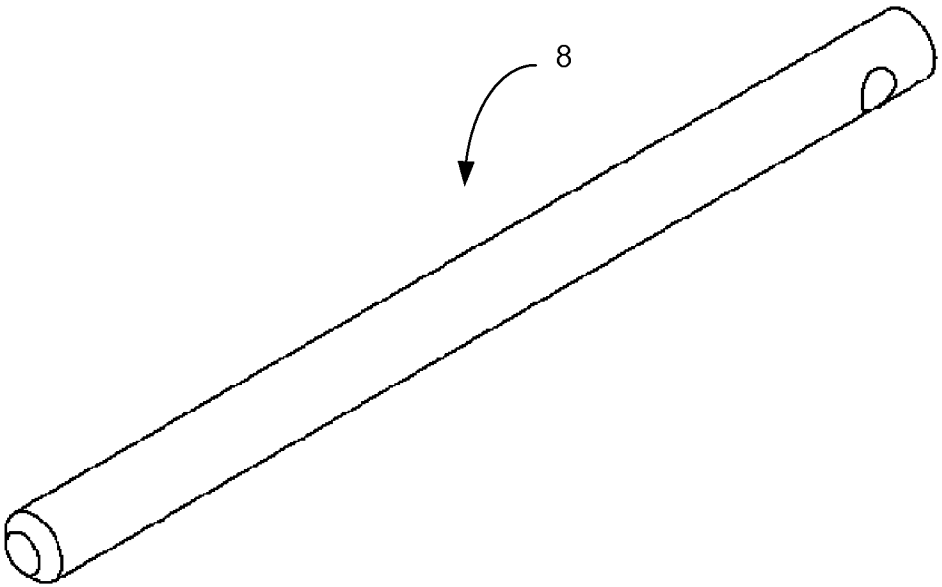
FIG. 10 shows an isometric view of the pin/shank component.

The engagement assembly 1 has an insertion or disengaged position, as illustrated in FIG. 3, and an engagement position, as illustrated in FIG. 4.

In the insertion position, as illustrated in FIG. 3, it can be seen that the fingers 2 and 3 are contracted closer together such that the end of the fingers 2 and 3, having end flanges 4 and 5, substantially abut each other. In this position the fingers 2 and 3 are thereby adapted to be inserted through an orifice 6 of an article 7.

In the engaged position, as illustrated in FIG. 4, the fingers 2 and 3 are more outwardly flared relative to their location in the insertion position shown in FIG. 3. In that position the flanges 4 and 5 no longer abut each other, but rather, are separated (as will be hereinafter described) to thereby prevent withdrawal of said assembly 1 from the orifice 6 of the article 7.

A shank 8 is disposed intermediate the fingers 2 and 3 and is operably moved in an axial direction in a substantially reciprocating manner, as will be hereinafter described, between a retracted position, as illustrated in FIG. 3, and, a protruded position, as illustrated in FIG. 4.

When the engagement assembly 1 is in the engaged position, the shank is positioned substantially intermediate the flanges 4 and 5 to thereby prevent them from moving together, thereby effectively locking the engagement assembly 1 to the article 7.

The engagement assembly 1 may further include a lever 9 which can be user operated to effect relative movement of each finger(s) relative to the other(s) either directly, or indirectly via the shank 8. In the illustrated embodiment, the shank 8 is attached to the lever 9 via a slidable pivot pin arrangement 10. In the embodiment shown, the slidable pivot pin arrangement is formed by pin 11 attached to shank 8 engaging with slot 12.

In use, as lever 9 is moved in a rotating manner about pivot pin 13, shank 8, via the slidable pivot pin attachment 10, undergoes substantially axial movement. As shank 8 is intermediate fingers 2 and 3, this in turn thereby affects and controls relative movement of the fingers 2 and 3 between their insertion positions shown in FIG. 2 and, their engaged positions, shown in FIG. 1. This movement of lever 9 is guided by cooperative abutment of engaging edges 15 and 16, thereby rotatably controlling the pivotal movement, of the fingers 2 and 3 about pivot 14.

The engagement assembly has a main body, formed by a plurality of body portions 18 (FIG. 7), 19 (FIG. 8) and 20 (FIG. 9), each of which are pivotally movable relative to each other about pivot points 13 and 14. The body portion 20 has a finger 3 integrally formed therewith, the body portion 19 has a finger 2 integrally formed with it and extending therefrom, and, the body portion 18 which is operatively connected to the shank 8 via pivot arrangement 10, has an integrally formed lever 9.

It will be appreciated that the engagement assembly 1 is therefore effectively operated in a scissor-like movement by operating level 9 to thereby cause pivotal movement of the fingers 2 and 3. This is facilitated and guided by the shank 8 disposed intermediate the fingers 2 and 3 which undergoes its reciprocal movement, being guided by slidable pivot arrangement 10. A user operates the engagement assembly 1 by rotating the lever 9 about pivot point 13, its movement being guided by abutting edges 15 and 16 on the respective body portions 18 and 20.

Body portions 18 and 19 further include cutouts 21 and 22, respectively. It will be understood that these cutouts, whilst being unaligned in the insertion position shown in FIG. 2, become aligned in the engaged position, as shown in FIG. 1. In the engaged position, an insert (not shown) may be positioned in the aligned cutouts 21 and 22 to thereby retain the engagement assembly in the engaged position, as any relative movement of the body portions 18, 19 and 20 is thereafter prevented. The insert may typically be a bolt, hook or other insert of appropriate shape, preferably fitting snugly in the aligned cutouts 21 and 22 to prevent relative movement therebetween.

In use, the engagement assembly is particularly useful for engaging a bolt hole or like orifice of a cutting edge or other component of an earthmoving, agricultural or like equipment. That is, fingers 2 and 3 are inserted into a bolt hole or other orifice of the cutting edge or other component of the equipment. Once inserted, the lever 9 of the engagement assembly 1 is operated such that the fingers 2 and 3 move apart to their engaged position, as shown in FIG. 1, thereby effectively locking the engagement assembly to the article or equipment. In such application, a shackle or other lifting hook of a crane or other lifting device may be inserted into the aligned cutouts 21 and 22, such that the cutting edge or other component may thereby be lifted or otherwise moved as required in a workshop situation. The engagement assembly of the present invention is preferably designed to support heavy workloads. It will be appreciated by persons skilled in the art that the device is quick and easy to use with minimal moving parts, and provides improved safety.

By way of example in the installation or removal of a cutting edge from an earth moving vehicle, firstly, one of the retaining bolts of the cutting edge may be removed.

The engagement assembly may then be placed in the insertion position, and the fingers of the engagement device may be inserted into the bolt hole orifice. Once inserted, the lever 9 is operated such that the device is placed in the engaged position whereby the cutouts 21 and 22 are aligned. Next, the lifting hook, shackle or the like may be placed through the cutouts. The cutting edge is now ready for removal utilising a suitable lifting device such as a crane or manual floor lift.

In use, it will be understood that objects desired to be lifted may have different sized orifices with which such an engagement assembly may be attached. For this purpose, a variety of covers of different sizes may be attached to the engagement assembly to sheath or pack out the fingers of the engagement assembly such that different sized orifices of objects or components may thereby be engaged. A variety of different sized covers 25, 26, 27 or sheaths are illustrated in FIGS. 11, 12 and 13, respectively. FIGS. 11(*a*), 12(*a*) and 13(*a*) show small, medium and large sized sheaths which are adapted to be received by the fingers 2 and 3. FIGS. 11(*b*), 12(*b*) and 13(*b*) show side elevational views of the assembly, with the respective covers or sheaths shown in 11(*a*), 12(*a*) and 13(*a*) being attached thereto. As will be seen, the fingers are thereby packed out to different sizes such that the engagement assembly can be used to engage orifices of objects of different sizes.

It will be appreciated by person skilled in the art that cutting edges are typically disposed at an inclined angle relative to the earth moving vehicle. As such, the cutout into which the lifting hook is positioned may be angularly disposed relative to the fingers, such that, for particular cutting edges, the edge may be moved at an appropriately inclined angle, for ease of installation of the component to the earth moving vehicle.

It will be therefore understood by persons skilled in the art that the engagement assembly of the present invention has significant advantages over prior art methods of installing or removing an article, such as a cutting edge from earth moving equipment.

It will be appreciated that there are other alterations and modifications to the present invention that will become apparent to persons skilled in the art. All such variations and modifications should be considered to fall within the scope of the invention as broadly hereinbefore described and as hereinafter claimed.

The invention claimed is:

1. An engagement assembly, adapted to securely engage an orifice of an article, the assembly including:

a first body portion, having a first elongate finger extending therefrom, including a first end flange thereon;

a second body portion, pivotally attached to said first body portion, having a second elongate finger extending therefrom, including a second end flange thereon, the second body portion also including a first cutout adapted to receive an insert;

a third body portion, pivotally attached to said second body portion, having a lever integrally formed therewith, the third body portion including a second cutout adapted to be alignable with said first cutout;

a shank disposed intermediate said fingers, and attached to said third body portion via a slidable pivot pin, the shank being axially movable in a substantially reciprocating manner upon movement of said lever;

wherein, said engagement assembly is adapted to be movable between an insertion position and an engaged position, whereby:

in said insertion position, said shank is withdrawn to permit said fingers to be contracted together such that said end flanges are positioned proximal to each other so that the end flanges are adapted to be inserted through said orifice of said article; and, in said engaged position, said shank is extended and positioned substantially intermediate said fingers whereby said end flanges are flared outwards relative to their position in the insertion position to thereby prevent withdrawal of said engagement assembly from said orifice of said article, the engagement assembly being retained in this position by said insert being positioned within said aligned cutouts.

2. An engagement assembly as claimed in claim 1, wherein said assembly is used to engage a bolt hole or like orifice of a cutting edge or other component of an earthmoving, agricultural or like equipment.

3. An engagement assembly as claimed in claim 1, herein said insert is a shackle or lifting hook of a crane or other lifting device.

4. An engagement assembly, as claimed in claim 1, further including:

a cover, attachable to at least one of said fingers, to thereby adjust the size or shape of said finger(s) such that said finger(s) are of compatible size or shape to said orifice.

5. An engagement assembly as claimed in claim 4, wherein each said cover is removably attachable to said finger.

6. A method of securing an engagement assembly to an orifice of an article, the method comprising:

providing an engagement assembly as in claim 1;

securing the engagement assembly to the orifice of the article.

* * * * *